US006434973B2

(12) United States Patent
Davidian

(10) Patent No.: US 6,434,973 B2
(45) Date of Patent: Aug. 20, 2002

(54) PROCESS AND UNIT FOR THE PRODUCTION OF A FLUID ENRICHED IN OXYGEN BY CRYOGENIC DISTILLATION

(75) Inventor: Benoit Davidian, Saint Maur des Fosses (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/825,341

(22) Filed: Apr. 4, 2001

(30) Foreign Application Priority Data

Apr. 4, 2000 (FR) ..... 00 04284

(51) Int. Cl.[7] ..... F25J 3/00
(52) U.S. Cl. ..... 62/648; 62/651
(58) Field of Search ..... 62/643, 651, 646, 62/648

(56) References Cited

U.S. PATENT DOCUMENTS 4,698,073 A * 10/1987 Rohde et al. ..... 55/33
5,651,271 A * 7/1997 Fraysse et al. ..... 62/646
5,893,276 A * 4/1999 Higginbotham ..... 62/651

FOREIGN PATENT DOCUMENTS

| | | |
|---|---|---|
| EP | 0 514 163 | 11/1992 |
| EP | 0 552 747 | 7/1993 |
| EP | 0 558 082 | 9/1993 |
| EP | 0 687 876 | 12/1995 |
| EP | 0 795 728 | 9/1997 |
| EP | 0 841 525 A2 | 5/1998 |
| EP | 841525 A2 * | 5/1998 |

* cited by examiner

*Primary Examiner*—William C. Doerrler
(74) *Attorney, Agent, or Firm*—Young & Thompson

(57) ABSTRACT

A plant for the separation of air includes at least three columns, including an auxiliary column and two other columns, of which at least one is fed with air and of which that operating at the lowest pressure operates between 2 and 10 bar. A flow between 40 and 95 mol % of argon originating from the auxiliary column is optionally mixed with a gas enriched in nitrogen from the column operating at the lowest pressure. The auxiliary column operates at the same pressure as the column from which it is fed.

20 Claims, 2 Drawing Sheets

PROCESS AND UNIT FOR THE PRODUCTION OF A FLUID ENRICHED IN OXYGEN BY CRYOGENIC DISTILLATION

BACKGROUND OF THE INVENTION

The present invention relates to a process and to a unit for the production of a fluid enriched in oxygen by cryogenic distillation of a mixture comprising nitrogen, oxygen and argon.

It relates in particular to a process and to a unit for the separation of air by cryogenic distillation which makes possible the production of pure oxygen, that is to say oxygen comprising at least 95 mol % of oxygen, preferably at least 98 mol % of oxygen or even 99.5 mol % of oxygen.

When it is desired to prepare pure oxygen, the oxygen necessarily has to be separated from the argon. If the columns of the unit all operate at a pressure above 2 bar, distillation is difficult.

The production of pure argon requires a column having more than 100 theoretical plates.

Patent Application EP-A-0 540 900 discloses a process for the production of impure oxygen in which a portion of the impure argon comprising at least 90% of argon from a mixing column is mixed with the residual nitrogen from a simple column. The mixing column operates at the same low pressure as the low pressure column, up to 1.75 bara.

EP-A-0 384 213 has a low pressure column operating at between 1.5 and 10 bara but the argon column operates at a lower pressure.

U.S. Pat. No. 4,932,212 discloses the case in which the low pressure column and the argon column operate at pressures between 1 and 2 bar.

EP-A-0 518 491 discloses a process for the production of gaseous nitrogen under pressure and secondarily liquid nitrogen, liquid argon and liquid oxygen, in which process the low pressure column and the argon column operate at a substantially identical pressure above 2.5 bara. No gaseous argon flow is produced.

EP-A-0 952 415 discloses a unit comprising a double column and an argon column operating with an output below the optimum output.

SUMMARY OF THE INVENTION

One aim of the present invention is to increase the output of pure oxygen from an air separation unit.

Another aim of the invention is to provide an air separation unit which is particularly well suited to demands for large amounts of nitrogen under pressure (typically in the case of integration with a gas turbine of an IGCC).

According to one subject-matter of the invention, a process for the production of a flow enriched in oxygen in a cryogenic distillation unit is provided which comprises the stages of:

a) cooling a feed flow comprising oxygen, nitrogen and argon and introducing this flow into a distillation unit comprising an auxiliary column for separating a flow comprising at least argon and oxygen and at least two other columns;

b) separating this flow by cryogenic distillation in the unit, in order to form fluids enriched in oxygen and in nitrogen;

c) conveying the flow comprising at least argon and oxygen from one of the other columns to the auxiliary column, the auxiliary column operating substantially at the same pressure as the column from which originates the flow comprising at least argon and oxygen, this pressure being between 2 and 10 bar absolute;

d) withdrawing a flow enriched in oxygen from a column of the unit comprising at least 95 mol % of oxygen, optionally 98 mol % of oxygen;

e) withdrawing a flow enriched in argon from the auxiliary column;

characterized in that at least a portion of the flow enriched in argon is discharged to the atmosphere and/or is used to regenerate reversible exchangers or adsorbent beds and/or at least a portion of the flow enriched in argon is used as product, after being mixed with a gas enriched in nitrogen from the unit and/or another unit.

For example, the flow enriched in argon or the flow enriched in argon mixed with a gas enriched in nitrogen can be conveyed upstream of the pressure-reducing device of a gas turbine.

The flow enriched in argon can comprise between 10 and 95 mol % of argon (or between 40 and 95 mol % of argon), between 2 and 40 mol % of oxygen and between 2 and 40 mol % of nitrogen.

Optionally, all the flow enriched in argon is discharged to the atmosphere and/or is used to regenerate reversible exchangers or adsorbent beds and/or is mixed with a residual gas from the unit and/or another unit and/or conveyed upstream of the pressure-reducing device of a gas turbine.

In this case, there may all the same be production of argon, for example by withdrawing a flow richer in argon from the auxiliary column, which is the product.

The flow enriched in argon which is discharged to the atmosphere and/or is used to regenerate reversible exchangers or adsorbent beds and/or which is mixed with a gas enriched in nitrogen from the unit and/or another unit and/or which is conveyed upstream of the pressure-reducing device of a gas turbine can constitute between 0.3 and 2% of the air, preferably between 0.5 and 1% of the air. For this reason, it is preferable to mix the flow enriched in argon with a gas enriched in nitrogen comprising at least 90 mol % of nitrogen, for example originating from the low pressure column of a double column, and to use the mixture for regenerating reversible exchangers or adsorbent beds and/or to convey the mixture to a gas turbine and/or to reduce the mixture in pressure in a turbine. Thus, the mixture formed comprises less than 2 mol % of argon, preferably less than 1 mol % of argon.

The low pressure column can operate between 2 and 10 bara, preferably above 2.5 bara.

For example, the unit can comprise an auxiliary column for separation of a flow comprising at least argon and oxygen and two other columns, including a high pressure column and a low pressure column connected thermally to one another, the auxiliary column being fed from the low pressure column.

Alternatively, the unit can comprise an auxiliary column for separation of a flow comprising at least argon and oxygen and at least three other columns, including a high pressure column, an intermediate pressure column and a low pressure column connected thermally to one another, the auxiliary column being fed from the low pressure column or the intermediate pressure column.

According to another subject-matter of the invention, an integrated process for separation of air and the production of energy is provided, in which process a gas enriched in nitrogen is conveyed from the column preferably operating at the lowest pressure to the gas turbine, after an optional compression stage, and a fluid enriched in oxygen is optionally conveyed from a column of the unit to a gasifier.

According to another subject-matter of the invention, a unit for the production of oxygen by cryogenic distillation is provided which comprises:

a) an auxiliary column and at least two other columns;

b) means for conveying a flow comprising oxygen, nitrogen and argon to one of the other columns;

c) means for withdrawing a flow enriched in oxygen from one of the other columns;

d) means for withdrawing a flow comprising at least argon and oxygen from one of the other columns and means for conveying this flow as feed to the. auxiliary column;

e) means for withdrawing a fluid enriched in argon from the auxiliary column;

characterized in that the auxiliary column comprises between 1 and 99 theoretical plates and in that the unit comprises pressure-reducing turbine, means for conveying a gas from the column operating at the lowest pressure, apart from the auxiliary column, to the pressure-reducing turbine, these means not comprising compression means, and means for conveying at least a portion of the fluid enriched in argon to the atmosphere and/or means for conveying at least a portion of the fluid enriched in argon to reversible exchangers or adsorbent beds, in order to regenerate them, and/or means for mixing at least a portion of the fluid enriched in argon with a residual gas from the unit or another unit and/or means for conveying at least a portion of the fluid enriched in argon to a gas turbine.

Preferably, there are no pressure-reducing means between the column feeding the auxiliary column and the auxiliary column.

The auxiliary column optionally comprises between 30 and 40 theoretical plates.

Thus, with an auxiliary column operating at the same pressure as the low pressure column and preferably operating at a pressure above 2 bar, the separation of oxygen and argon in the collector of the low pressure column is facilitated. In this case, the fluid enriched in argon withdrawn from the auxiliary column is not necessarily a final product from the unit but can be used to cool the flows entering the columns or to provide cooling by reduction in pressure.

BRIEF DESCRIPTION OF THE DRAWINGS

The invention will be described in more detail with reference to the figures.

DETAILED DESCRIPTION OF THE PREFERRED EMBODIMENTS

Figure 1:
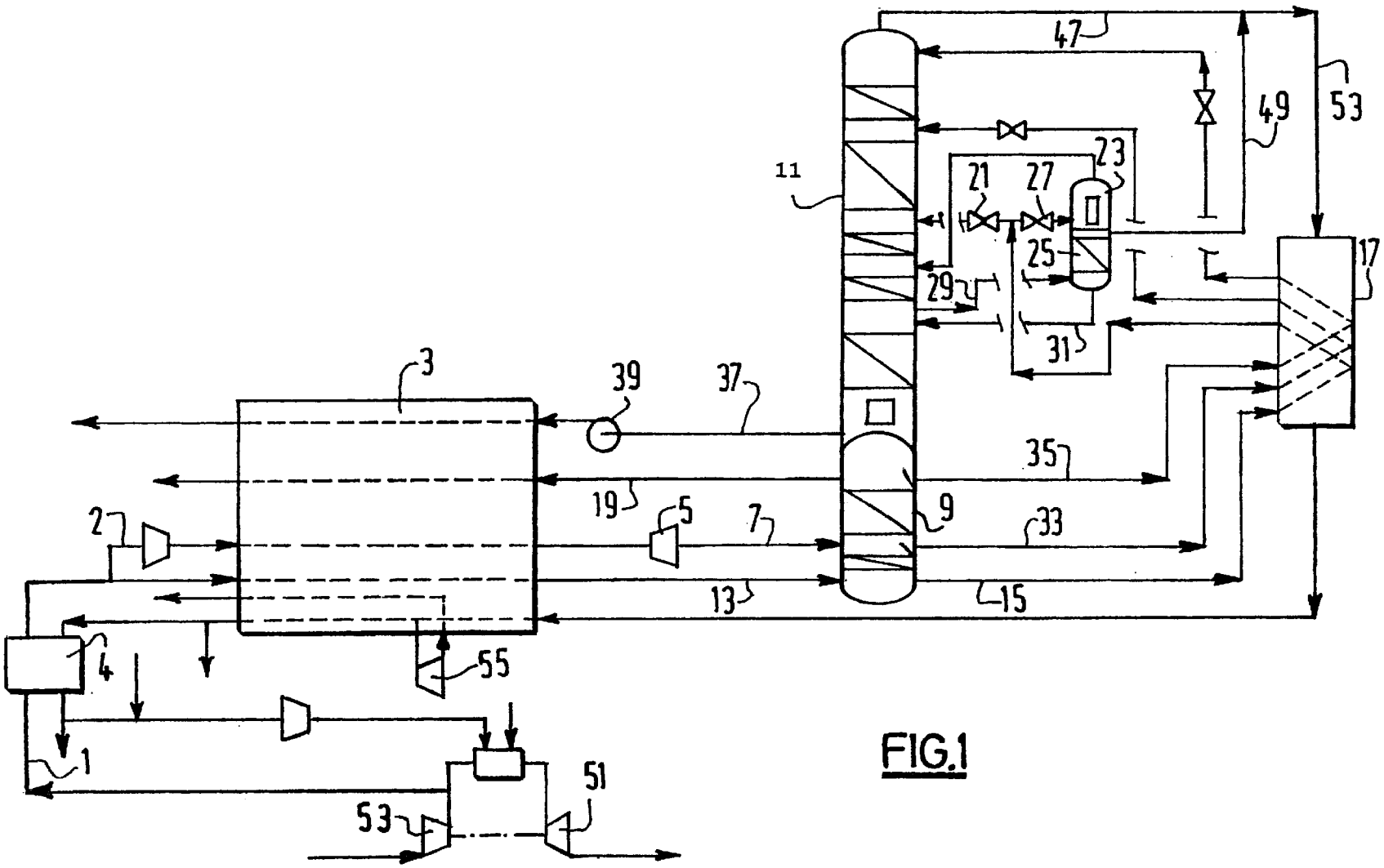
FIG. 1 is a diagram of a unit for the production of oxygen according to the invention using a double column.

In FIG. 1, an air flow 1 of 1000 $Sm^3/h$ is purified by adsorbent beds 4 and divided into two. The flow 2 is overpressurized to a higher pressure, conveyed into the heat exchanger 3, where it is cooled by the evaporation of liquid oxygen, and subsequently conveyed to a water turbine 5, from which it emerges in an at least partially liquid form. This liquid (or two-phase mixture) 7 is conveyed to the high pressure column 9 operating between 14 and 15 bar and optionally in part to the low pressure column 11 operating between 4 and 6 bar (or even between 2 and 10 bar), either by conveying a portion of the liquid from a tank upstream of the medium pressure column or by withdrawing a flow having a similar composition to that of liquid air from the high pressure column 9, as shown in FIG. 1.

The remainder of the air 13 at 14.4 bara is conveyed to the high pressure column 9.

The unit can optionally comprise a blower turbine which is used during the start-up or a low pressure nitrogen turbine 55.

A flow of rich liquid 15 is withdrawn from the high pressure column and conveyed to the subcooler 17, divided into two and conveyed in part to the low pressure column, after a reduction in pressure in the valve 21, and in part to the top condenser 23 of the auxiliary column 25, after a reduction in pressure in the valve 27. The rich liquid, at least partially evaporated in the top condenser, is conveyed to the low pressure column 11. If the evaporation is partial, a liquid flow and a gas flow are conveyed from the condenser to the low pressure column.

A flow of gaseous nitrogen 19 can optionally be withdrawn from the top of the high pressure column 9.

The auxiliary column is fed with a gas flow 29 comprising between 5 and 15 mol % of argon, preferably approximately 7 mol % of argon. The collector liquid 31 from the auxiliary column is conveyed to the low pressure column, which operates substantially at the same pressure as the auxiliary column.

The auxiliary column 25 can alternatively be fed with a liquid flow comprising between 5 and 15 mol % of argon, preferably approximately 7 mol % of argon. In this case, the column 25 will have a collector reboiler, heated by a gas flow such as air or nitrogen from the high pressure column 9.

A flow of liquid air 33 and a flow of depleted liquid 35 are conveyed from the high pressure column 9 to the low pressure column 11, after having been subcooled in the subcooler 17 and reduced in pressure in valves.

A flow of liquid oxygen 37 comprising 99.5 mol % of oxygen is withdrawn from the collector of the low pressure column, pressurized by a pump 39 and evaporated in the exchanger 3.

A gas enriched in argon 49 constituting between 0.5 and 1% of the air conveyed to the unit and comprising between 40 and 95 mol % of argon withdrawn from the top of the auxiliary column 25 is mixed with the residual nitrogen 47 from the top of the low pressure column. The mixture 53 is reheated in the subcooler 17 and then reheated in the exchanger 3. The mixture can subsequently be discharged to the atmosphere and/or can be used to regenerate reversible exchangers beds 4 or adsorbent beds and/or conveyed upstream of the pressure-reducing device 51 of a gas turbine after a compression stage.

Optionally, beforehand, a portion of the mixture 53 can be reduced in pressure in a turbine 55 (in dotted lines).

In comparison with a conventional system with a high pressure column at 14.3 bara and a low pressure column at 4.8 bara but without an auxiliary column, the process of FIG. 1 makes it possible to increase the oxygen output from 78% to 90%.

Figure 2:
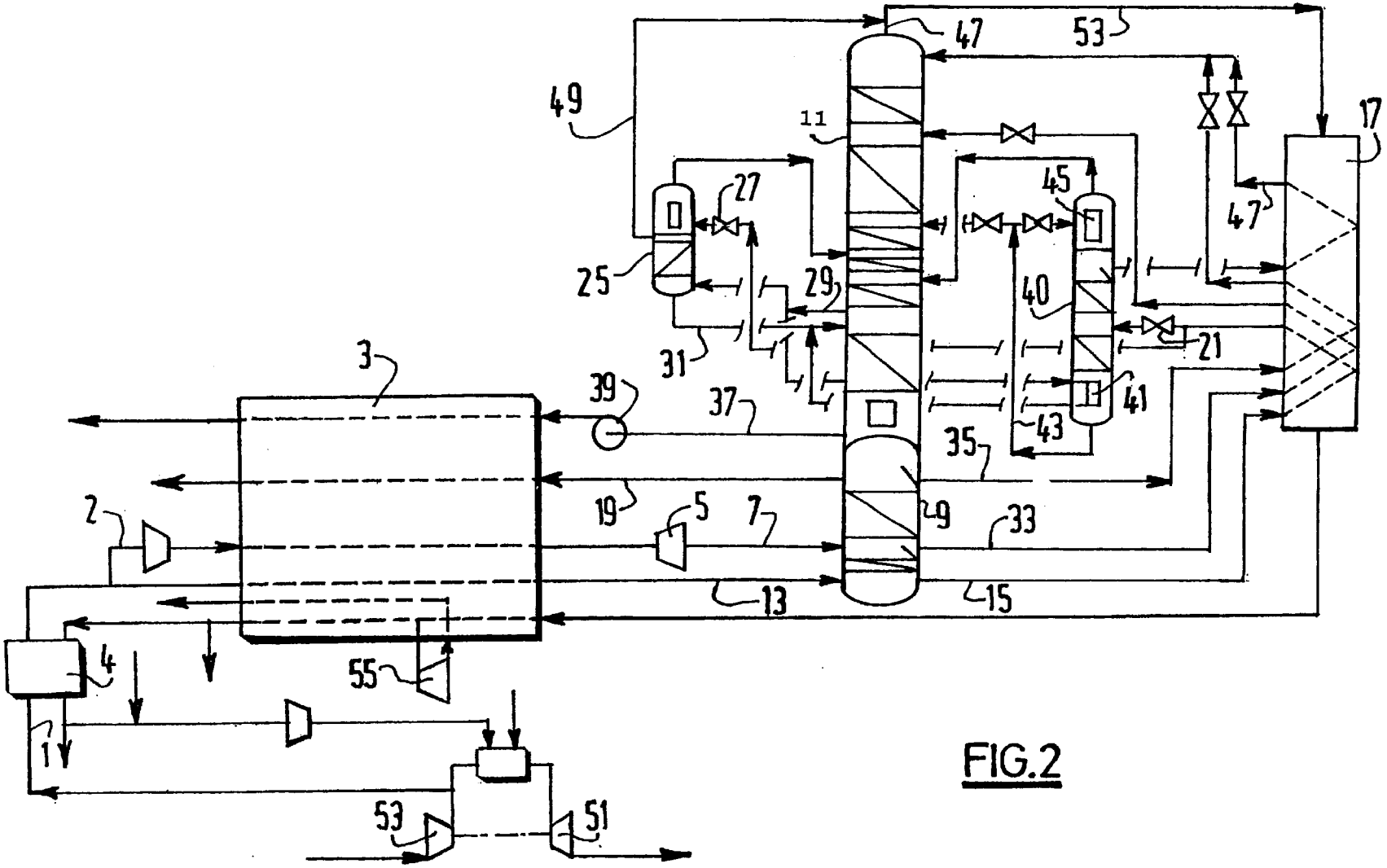
FIG. 2 is a diagram of a unit for the production of oxygen according to the invention using a triple column.

In FIG. 2, a triple column is used instead of the double column in FIG. 1. An air flow 1 is purified by adsorbent beds 4 and divided into two. The flow 2 is overpressurized to a higher pressure, conveyed into the heat exchanger 3, where it is cooled by the evaporation of liquid oxygen, and subsequently conveyed to a water turbine 5, from which it emerges in an at least partially liquid form. This liquid (or two-phase mixture) 7 is conveyed to the high pressure column 9 operating between 14 and 15 bar and optionally in part to the low pressure column 11 operating between 4 and 6 bar and/or optionally to the intermediate pressure column 40 operating between 7 and 9 bar, either by conveying a portion of the liquid from a tank upstream of the medium pressure column or by withdrawing a flow having a similar composition to that of liquid air from the high pressure column 9, as shown in FIG. 2.

The remainder of the air 13 at 14.4 bara is conveyed to the high pressure column 9.

The unit can optionally comprise a blower turbine which is used during the start-up or a low pressure nitrogen turbine 55.

A flow of rich liquid 15 is withdrawn from the high pressure column and conveyed to the subcooler 17, divided into two and conveyed in part to the middle of the column operating at intermediate pressure 40, after a reduction in pressure in the valve 21, and in part to the top condenser 23 of the auxiliary column 25, after a reduction in pressure in the valve 27. The rich liquid, at least partially evaporated in the top condenser, is conveyed to the low pressure column 11. If the evaporation is partial, a liquid flow and a gas flow are conveyed from the condenser to the low pressure column.

A flow of gaseous nitrogen 19 can optionally be withdrawn from the top of the high pressure column 9.

The auxiliary column is fed with a portion of a gas flow 29 comprising between 5 and 15 mol % of argon, preferably approximately 7 mol % of argon. The collector liquid 31 from the auxiliary column is conveyed to the low pressure column, which operates substantially at the same pressure as the auxiliary column.

The auxiliary column 25 can alternatively be fed with a liquid flow comprising between 5 and 15 mol % of argon, preferably approximately 7 mol % of argon. In this case, the column 25 will have a collector reboiler, heated by a gas flow such as air or nitrogen from the high pressure column 9.

The remainder of the gas flow 29 is used to heat the bottom reboiler 41 of the column 40 and, after condensation, is conveyed to the low pressure column with the flow 31.

The collector liquid 43 from the column 40 is conveyed in part directly to the low pressure column and in part to the top condenser of the column 40, where it is at least partially evaporated before being conveyed in its turn to the low pressure column.

The top liquid 47 from the column 40 is subcooled in the exchanger 17, reduced in pressure, mixed with the pressure-reduced flow 35 and conveyed to the top of the low pressure column.

A flow of liquid air 33 and a flow of depleted liquid 35 are conveyed from the high pressure column 9 to the low pressure column 11, after having been subcooled in the subcooler 17 and reduced in pressure in valves.

A flow of liquid oxygen 37 comprising 99.5 mol % of oxygen is withdrawn from the collector of the low pressure column, pressurized by a pump 39 and evaporated in the exchanger 3.

A gas enriched in argon 49 constituting between 0.5 and 1% of the air conveyed to the unit and comprising between 40 and 95 mol % of argon withdrawn from the top of the auxiliary column 25 is mixed with the residual nitrogen 47 from the top of the low pressure column. The mixture 53 is reheated in the subcooler 17 and then reheated in the exchanger 3. The mixture can subsequently be discharged to the atmosphere and/or can be used to regenerate reversible exchangers or adsorbent beds 4 and/or conveyed upstream of the pressure-reducing device 51 of a gas turbine after an optional compression stage.

Optionally, beforehand, a portion of the mixture 53 can be reduced in pressure in a turbine 55 (in dotted lines).

The process according to the invention is of particular advantage in the case in which the nitrogen from the low pressure column is recovered for example by conveying it to a pressure-reducing device 51 of a gas turbine. In this case, at least a portion of the air 1 can originate from the compressor 53 of the gas turbine and the oxygen produced by the distillation unit can be used for the gasification necessary to produce the fuel for the gas turbine.

I claim:

1. Process for the production of a flow enriched in oxygen in a cryogenic distillation unit, which comprises the stages of:

a) cooling a feed flow (1) comprising oxygen, nitrogen and argon and introducing this flow into a distillation unit comprising an auxiliary column (25) for separating a flow (29) comprising at least argon and oxygen and at least two other columns (9, 11);

b) separating this flow by cryogenic distillation in the unit, in order to form fluids enriched in oxygen and in nitrogen (15, 33, 35);

c) conveying the flow comprising at least argon and oxygen from one of the other columns to the auxiliary column, the auxiliary column operating substantially at the same pressure as the column (11) from which originates the flow comprising at least argon and oxygen, this pressure being between 2 and 10 bar absolute;

d) withdrawing a flow enriched in oxygen (37), comprising at least 95 mol % of oxygen, from a column of the unit;

e) withdrawing a flow enriched in argon (49) from the auxiliary column;

characterized in that at least a portion of the flow enriched in argon (49) is discharged to the atmosphere and/or is used to regenerate reversible exchangers or adsorbent beds (4) and/or at least a portion of the flow enriched in argon is used as product, after being mixed with a gas enriched in nitrogen (47) from the unit and/or another unit.

2. Process according to claim 1, in which the flow enriched in argon (49) comprises between 10 and 95 mol % of argon.

3. Process according to claim 2, in which the flow enriched in argon (49) comprises between 40 and 95 mol % of argon.

4. Process according to claim 1, in which the flow enriched in argon (49) comprises between 2 and 40 mol % of oxygen.

5. Process according to claim 1, in which at least a portion of the flow enriched in argon (49) is discharged to the atmosphere, optionally after having mixed it with a gas enriched in nitrogen from the unit.

6. Process according to claim 1, in which at least a portion of the flow enriched in argon (49) is used to regenerate reversible exchangers or adsorbent beds (4), optionally after having mixed it with a gas enriched in nitrogen from the unit.

7. Process according to claim 1, in which at least a portion of the flow enriched in argon (49) is conveyed upstream of the pressure-reducing device (51) of a gas turbine, optionally after having mixed it with a gas enriched in nitrogen from the unit.

8. Process according to claim 1, wherein all the flow enriched in argon is at least one of discharged to the atmosphere, used to regenerate reversible exchangers or adsorbent beds, and used as final product, after being mixed with a gas enriched in nitrogen from the unit.

9. Process according to claim 1, in which a fluid enriched in argon is produced as final product.

10. Process according to claim 1, in which at least a portion of the flow (49) enriched in argon is conveyed to a pressure-reducing turbine (53) or a pressure-reducing reducing valve, optionally after having been mixed with a gas flow enriched in nitrogen.

11. Process according to claim 1, in which the unit comprises an auxiliary column (25) for separation of a flow comprising at least argon and oxygen and two other columns, including a high pressure column (9) and a low pressure column (11) connected thermally to one another, the auxiliary column being fed from the low pressure column.

12. Process according to claim 1, in which the unit comprises an auxiliary column (25) for separation of a flow comprising at least argon and oxygen and at least three other columns, including a high pressure column (9), an intermediate pressure column (40) and a low pressure column (11) connected thermally to one another, the auxiliary column being fed from the low pressure column or the intermediate pressure column.

13. Integrated process for separation of air and for the production of energy, comprising a process according to claim 7, in which a fluid enriched in oxygen is conveyed from a column of the unit to a gasifier or at least a portion of the air intended for the distillation unit originates from a compressor (53) of the gas turbine.

14. Unit for the production of oxygen by cryogenic distillation, which comprises:

a) an auxiliary column (25) and at least two other columns (9, 11);

b) means for conveying a flow (1) comprising oxygen, nitrogen and argon to one of the other columns;

c) means for withdrawing a flow enriched in oxygen (37) from one of the other columns;

d) means for withdrawing a flow (29) comprising at least argon and oxygen from one of the other columns and means for conveying this flow as feed to the auxiliary column (25);

e) means for withdrawing a fluid enriched in argon from the auxiliary column;

characterized in that the auxiliary column comprises between 1 and 99 theoretical plates and there is a pressure-reducing turbine (53), means for conveying a gas (53) from the column operating at the lowest pressure (11), apart from the auxiliary column, to the pressure-reducing turbine, these means not comprising compression means, and means for conveying at least a portion of the fluid enriched in argon to the atmosphere and/or means for conveying at least a portion of the fluid enriched in argon to reversible exchangers or adsorbent beds, in order to regenerate them, and/or means for mixing at least a portion of the fluid enriched in argon with a gas enriched in nitrogen (47) from the unit or from another unit and/or means for conveying at least a portion of the fluid enriched in argon to a gas turbine.

15. Unit according to claim 14, in which there is no pressure-reducing means between the column (11) feeding the auxiliary column and the auxiliary column (25).

16. Unit according to claim 14, comprising means for conveying all the fluid enriched in argon to the atmosphere or means for mixing all the fluid enriched in argon with an enriched gas from the unit or another unit.

17. The unit according to claim 14, wherein said fluid enriched in argon is withdrawn from a top of the auxiliary column.

18. The unit according to claim 16, wherein said fluid enriched in argon is withdrawn from a top of the auxiliary column.

19. A process for the production of a flow enriched in oxygen in a cryogenic distillation unit, comprising the steps of:

a) cooling a feed flow comprising oxygen, nitrogen and argon, introducing the feed flow into a distillation unit having an auxiliary column for separating a flow including at least argon and oxygen, and at least two other columns;

b) separating the feed flow by cryogenic distillation in the cryogenic distillation unit, in order to form fluids enriched in oxygen and in nitrogen;

c) conveying the flow comprising at least argon and oxygen from one of the at least two other columns to the auxiliary column, the auxiliary column operating substantially at a same pressure as the one of the at least two other columns, the pressure being between 2 and 10 bar absolute;

d) withdrawing a flow enriched in oxygen, including at least 95 mol % of oxygen, from the one of the at least two other columns; and e) withdrawing a flow enriched in argon from a top of the auxiliary column;

where at least a portion of the flow enriched in argon is at least one of discharged to the atmosphere, used to regenerate reversible exchangers or adsorbent beds, and used as a product, after being mixed with a gas enriched in nitrogen from the unit.

20. The unit according to claim 19, wherein all the flow enriched in argon is at least one of discharged to the atmosphere, used to regenerate reversible exchanger or adsorbent beds, and used as a final product.

* * * * *